US009279570B2

(12) United States Patent
Lin et al.

(10) Patent No.: US 9,279,570 B2
(45) Date of Patent: Mar. 8, 2016

(54) BARREL ADJUSTMENT AND RETAINING ASSEMBLY

(71) Applicant: Genius Electronic Optical Co., Ltd., Central Taiwan Science Park (TW)

(72) Inventors: Zin-Cheng Lin, Central Taiwan Science Park (TW); Fu-Kuang Hsiao, Central Taiwan Science Park (TW)

(73) Assignee: Genius Electronic Optical Co., Ltd., Taichung (TW)

( * ) Notice: Subject to any disclaimer, the term of this patent is extended or adjusted under 35 U.S.C. 154(b) by 63 days.

(21) Appl. No.: 14/449,462

(22) Filed: Aug. 1, 2014

(65) Prior Publication Data

US 2015/0316236 A1 Nov. 5, 2015

(30) Foreign Application Priority Data

Apr. 30, 2014 (TW) ..... 103115582 A

(51) Int. Cl.
*F21V 17/02* (2006.01)
*F21V 5/04* (2006.01)
*F21L 4/04* (2006.01)

(52) U.S. Cl.
CPC . *F21V 17/02* (2013.01); *F21L 4/04* (2013.01); *F21V 5/04* (2013.01); *Y10T 29/49828* (2015.01)

(58) Field of Classification Search
CPC ..... F21V 17/02; F21V 5/04; F21L 4/04; Y10T 29/49828
USPC ..... 362/187, 188, 277, 319
See application file for complete search history.

(56) References Cited

U.S. PATENT DOCUMENTS

| | | | | |
|---|---|---|---|---|
| 5,113,326 | A * | 5/1992 | Maglica | F21L 4/005 137/859 |
| 6,726,342 | B1 * | 4/2004 | Lai | F21L 4/005 362/187 |
| 8,297,756 | B2 * | 10/2012 | Ouyang | F21V 14/06 353/101 |
| 8,371,710 | B2 * | 2/2013 | Gupta | F21L 4/027 362/187 |
| 2009/0268440 | A1 * | 10/2009 | Harnischmacher | F21L 4/027 362/187 |
| 2010/0002422 | A1 * | 1/2010 | Ho | F21L 4/027 362/187 |
| 2011/0080725 | A1 * | 4/2011 | Brands | F21L 4/027 362/187 |
| 2013/0329411 | A1 * | 12/2013 | Windom et al. | F21L 4/04 362/188 |

* cited by examiner

*Primary Examiner* — Laura Tso
(74) *Attorney, Agent, or Firm* — Jianq Chyun IP Office

(57) ABSTRACT

A barrel adjustment and retaining assembly includes a barrel body having an end surface, a seat body having a protrusion, a limiting component and an adjustment barrel. The seat body is movable relative to the barrel body. The protrusion is moved toward the end surface when the seat body moves from a pre-assembly position to an assembly position. The limiting component is clamped between the protrusion and the end surface to deform such that an outer diameter of the limiting component is increased when the seat body moves from the pre-assembly position to the assembly position. The adjustment barrel is sleeved slidably on the barrel body. The clamped limiting component is confined within a hole portion of the adjustment barrel.

10 Claims, 6 Drawing Sheets

BARREL ADJUSTMENT AND RETAINING ASSEMBLY

CROSS-REFERENCE TO RELATED APPLICATION

This application claims priority of Taiwanese Patent Application No. 103115582, filed on Apr. 30, 2014, the entire disclosure of which is hereby incorporated by reference.

BACKGROUND OF THE INVENTION

1. Field of the Invention

This invention relates to a barrel adjustment and retaining assembly, more particularly to a barrel adjustment and retaining assembly applicable to a variable-focus flashlight.

2. Description of the Related Art

Barrel adjustment and retaining assemblies have been widely developed in various applications in daily life, for example, a focus-adjustable flashlight that allows the user to adjust the relative position of an optical lens and an internal light source so as to provide a variable-focus effect from a wide floodlight to a narrow beam, or a finderscope that includes an eyepiece (or called an ocular lens) and an objective lens. The eyepiece is movable relative to the objective lens for conforming with different users.

Referring to FIGS. 1 and 2, a conventional barrel adjustment and retaining assembly includes a barrel body 11, an adjustment barrel 12 that has a large inner diameter (d1) and a small inner diameter (d2), that is sleeved on the barrel body 11, and that is movable on the barrel body 11 along an axial direction of the barrel body 11, a seat body 13 including a protrusion 131 and threaded to the barrel body 11, a light emitting element 14 disposed in the seat body 13, an optical lens 15 disposed in the adjustment barrel 12 and aligned with the light emitting element 14 along the axial direction, and a cover 16 threaded to the adjustment barrel 12 so as to secure the optical lens 15 to the adjustment barrel 12.

Since the protrusion 131 is made of a rigid material, and must have a diameter that is smaller than d1 and larger than d2. That is, during manufacture, a demand of a high-precision is required for the protrusion 131.

Moreover, since the seat body 13 is made of metal, the adjustment barrel 12 is likely to be damaged during relative movements between the protrusion 131 of the seat body 13 and the adjustment barrel 12, vibration and collision occur therebetween. Furthermore, during assembly, the barrel adjustment and retaining assembly is assembled in the following steps of: (a) sleeving the barrel body 11 in the adjustment barrel 12; (b) threading the seat body 13 on the barrel body 11; (c) connecting the optical lens 15 to the adjustment barrel 12; and (d) threading the cover 16 on the adjustment barrel 16. It should be noted that the steps must be done in a specific sequence, and therefore the assembling process is relatively difficult and time consuming. Moreover, the number of the components is relatively large and therefore the manufacturing cost is relatively high.

SUMMARY OF THE INVENTION

Therefore, the object of the present invention is to provide a barrel adjustment and retaining assembly that can overcome the aforesaid drawbacks of the prior art.

According to one aspect of the present invention, there is provided a barrel adjustment and retaining assembly that includes a barrel body, a seat body, a limiting component and an adjustment barrel. The barrel body has an end surface, an outer surface, an inner surface and an internal thread that is formed on the inner surface. The seat body has a protrusion that is registered with the end surface of the barrel body, an outer surrounding surface and an external thread that is formed on the outer surrounding surface and that is configured to engage the internal thread of the barrel body such that the seat body is movable relative to the barrel body between a pre-assembly position and an assembly position. The protrusion of the seat body is moved toward the end surface of the barrel body when the seat body moves from the pre-assembly position to the assembly position. The limiting component is disposed between the protrusion of the seat body and the end surface of the barrel body such that, when the seat body is in the pre-assembly position, the limiting component has a normal outer diameter, and when the seat body is in the assembly position, the limiting component deforms to have an operating outer diameter greater than the normal outer diameter. The adjustment barrel is sleeved slidably on the outer surface of the barrel body, and has an end surface, a large diameter hole portion that is spaced apart from the end surface of the adjustment barrel and that has a large diameter, a small diameter hole portion that is disposed between the large diameter hole portion and the end surface of the adjustment barrel and that has a small diameter smaller than the large diameter, and a shoulder surface that is formed between the large diameter hole portion and the small diameter hole portion. When the seat body is in the assembly position, the operating outer diameter of the limiting component is greater than the small diameter of the small diameter hole portion so that the shoulder surface of the adjustment barrel is movable to abut against the limiting component to thereby limit the limiting component to move in the large diameter hole portion.

According to another aspect of the present invention, there is provided a method for assembling a barrel adjustment and retaining assembly that includes the steps of:

(a) preparing a barrel body, a seat body, a limiting component and an adjustment barrel, the barrel body having an end surface, an inner surface and an internal thread that is formed on the inner surface, the seat body having a protrusion, an outer surrounding surface and an external thread that is formed on the outer surrounding surface, the limiting component being deformable, the adjustment barrel having an end surface, a large diameter hole portion that is spaced apart from the end surface of the adjustment barrel and that has a large diameter, a small diameter hole portion that is disposed between the large diameter hole portion and the end surface of the adjustment barrel and that has a small diameter smaller than the large diameter of the large diameter hole portion, and a shoulder surface that is formed between the large diameter hole portion and the small diameter hole portion.

(b) threading the internal thread of the barrel body on the external thread of the seat body to move the seat body to a pre-assembly position such that the limiting component is disposed between the protrusion 31 of the sat body 3 and the end surface 21 of the barrel body 2 and has a normal outer diameter;

(c) sleeving the adjustment barrel on the seat body and the barrel body such that the limiting component is disposed in the large diameter hole portion; and (d) threading the internal thread of the barrel body on the external thread of the seat body to move the seat body to an assembly position, such that the limiting component is clamped between the protrusion of the seat body and the end surface of the barrel body to deform to have an operating outer diameter greater than the normal outer diameter and greater than the small diameter of the small diameter hole portion, so that the shoulder surface of the adjustment barrel is movable to abut against the limiting component to thereby limit the limiting component to move in the large diameter hole portion.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
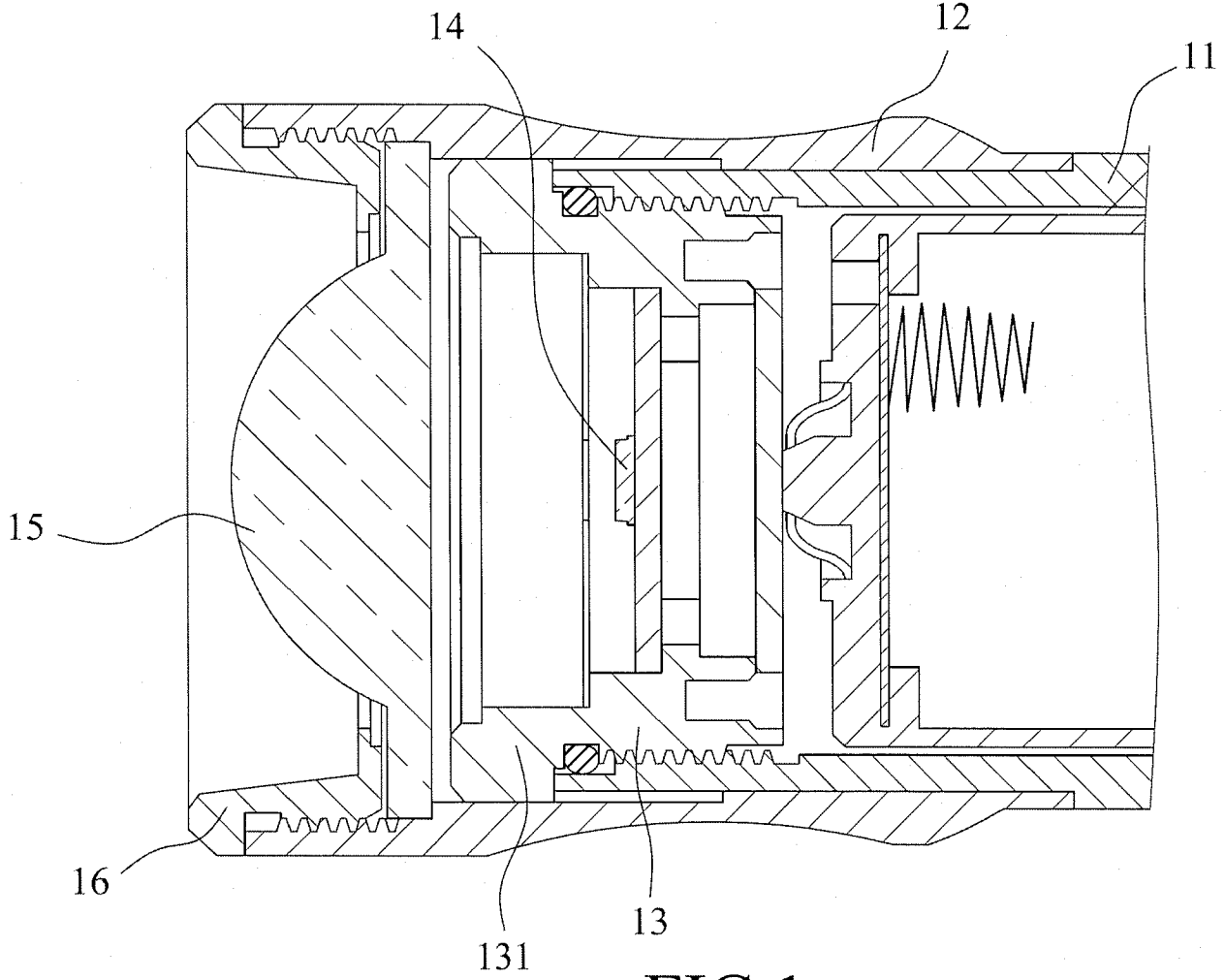
FIG.1 PRIOR ART
FIG. 1 is a fragmentary assembled sectional view of a conventional barrel adjustment and retaining assembly.
Figure 2:
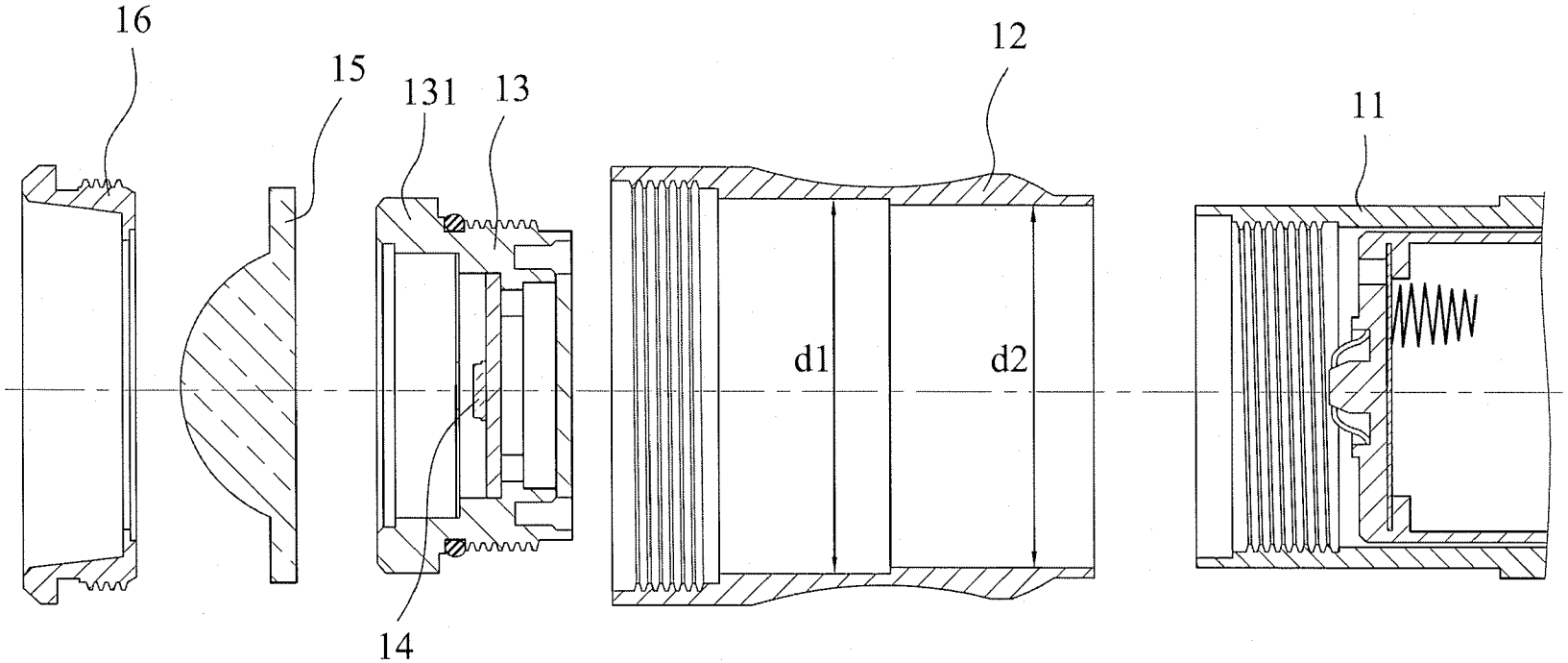
FIG.2 PRIOR ART
FIG. 2 is a fragmentary exploded sectional view of the conventional barrel adjustment and retaining assembly in FIG. 1.
Figure 3:
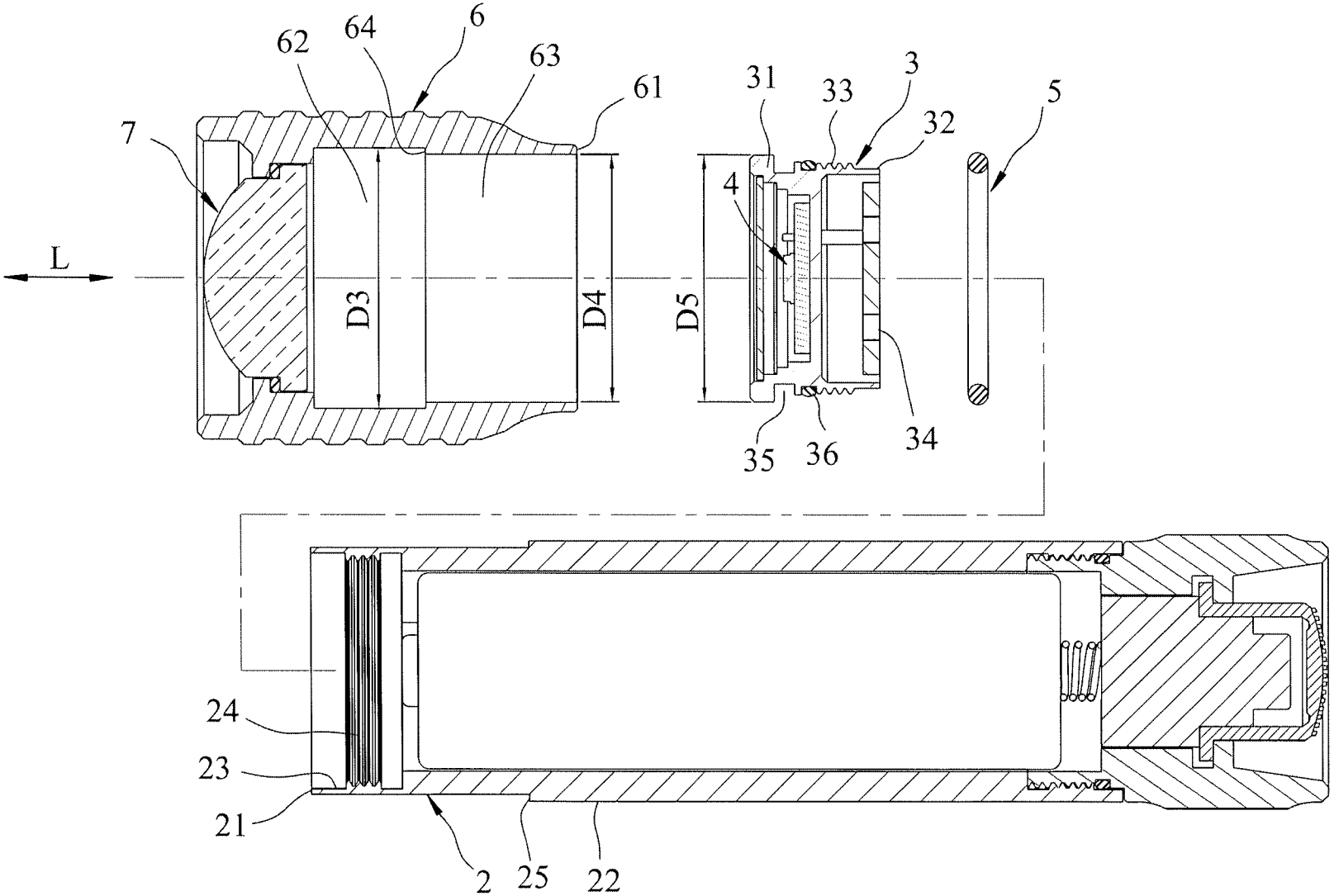
FIG. 3 is an exploded sectional view of the preferred embodiment of a barrel adjustment and retaining assembly according to this invention.
Figure 4:
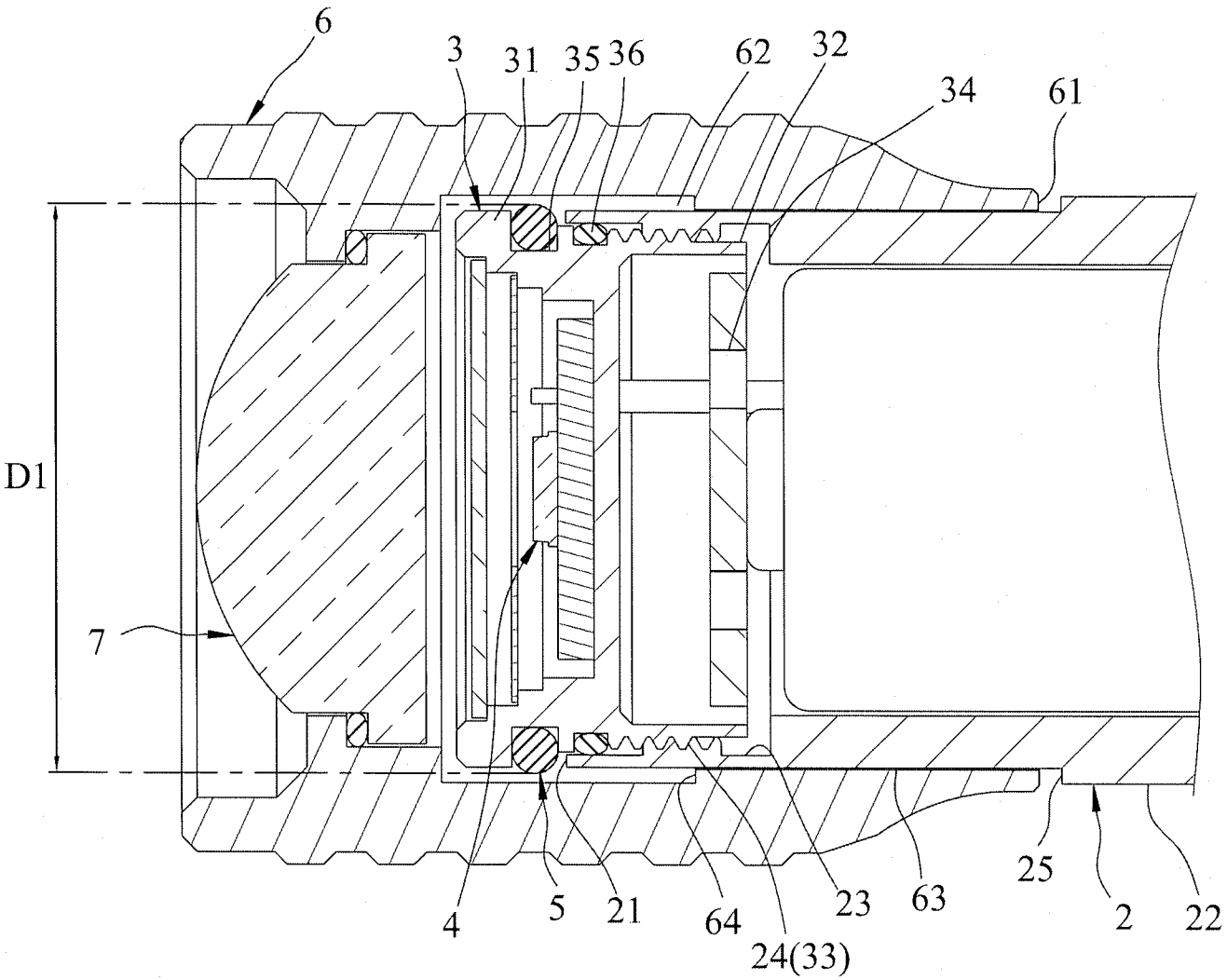
FIG. 4 is a fragmentary assembled sectional view of the preferred embodiment, showing that a seat body is in a pre-assembly position.

Referring to FIGS. 3 to 6, the preferred embodiment of a barrel adjustment and retaining assembly according to the present invention includes a barrel body 2, a seat body 3, a limiting component 5 and an adjustment barrel 6.

The barrel body 2 has an end surface 21, an outer surface 22 that has a shoulder surface portion 25, an inner surface 23, and an internal thread 24 that is formed on the inner surface 23.

Figure 5:
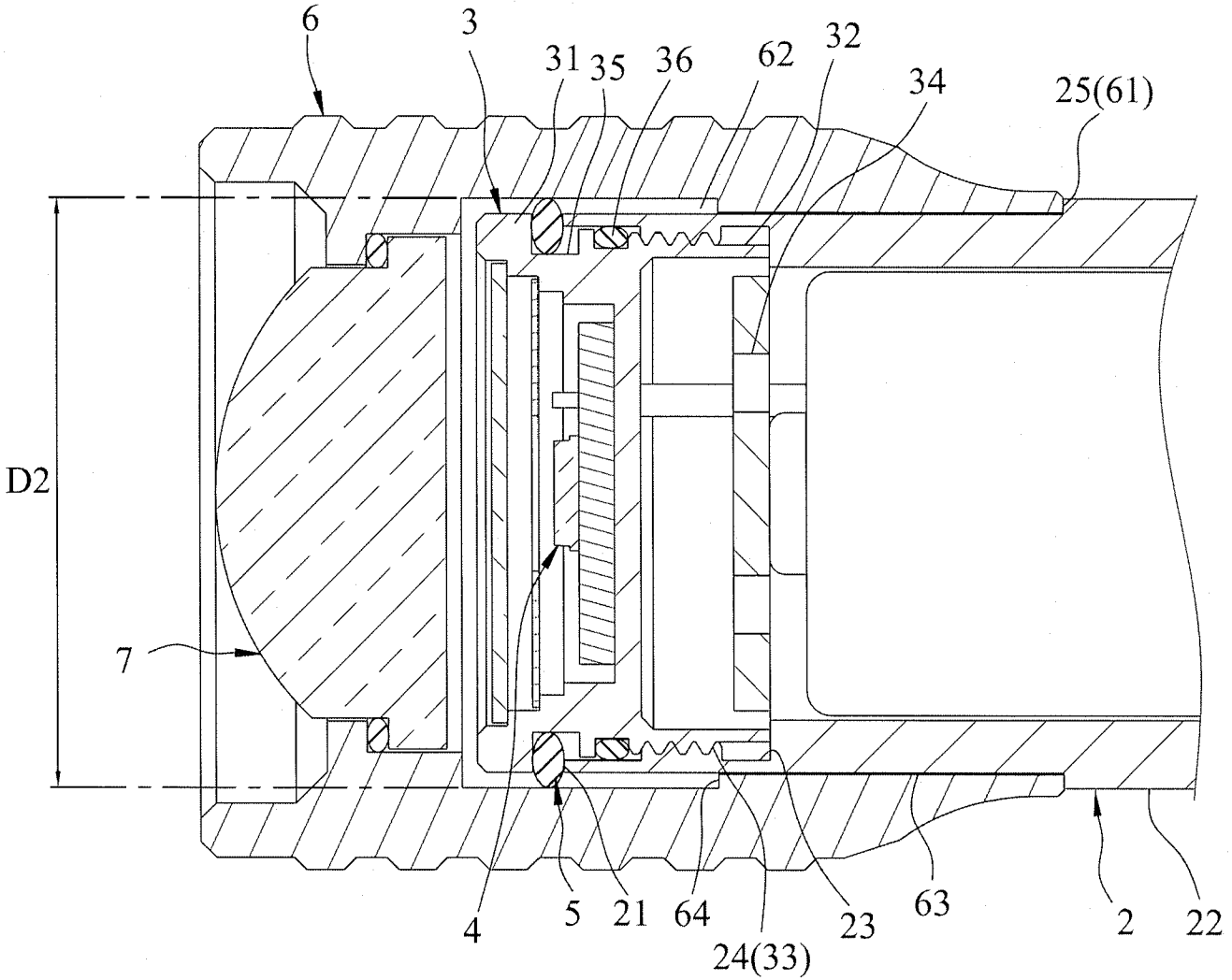
FIG. 5 is a fragmentary assembled sectional view of the preferred embodiment, showing that the seat body is in an assembly position and the barrel adjustment and retaining assembly is in a shortened state.
Figure 6:
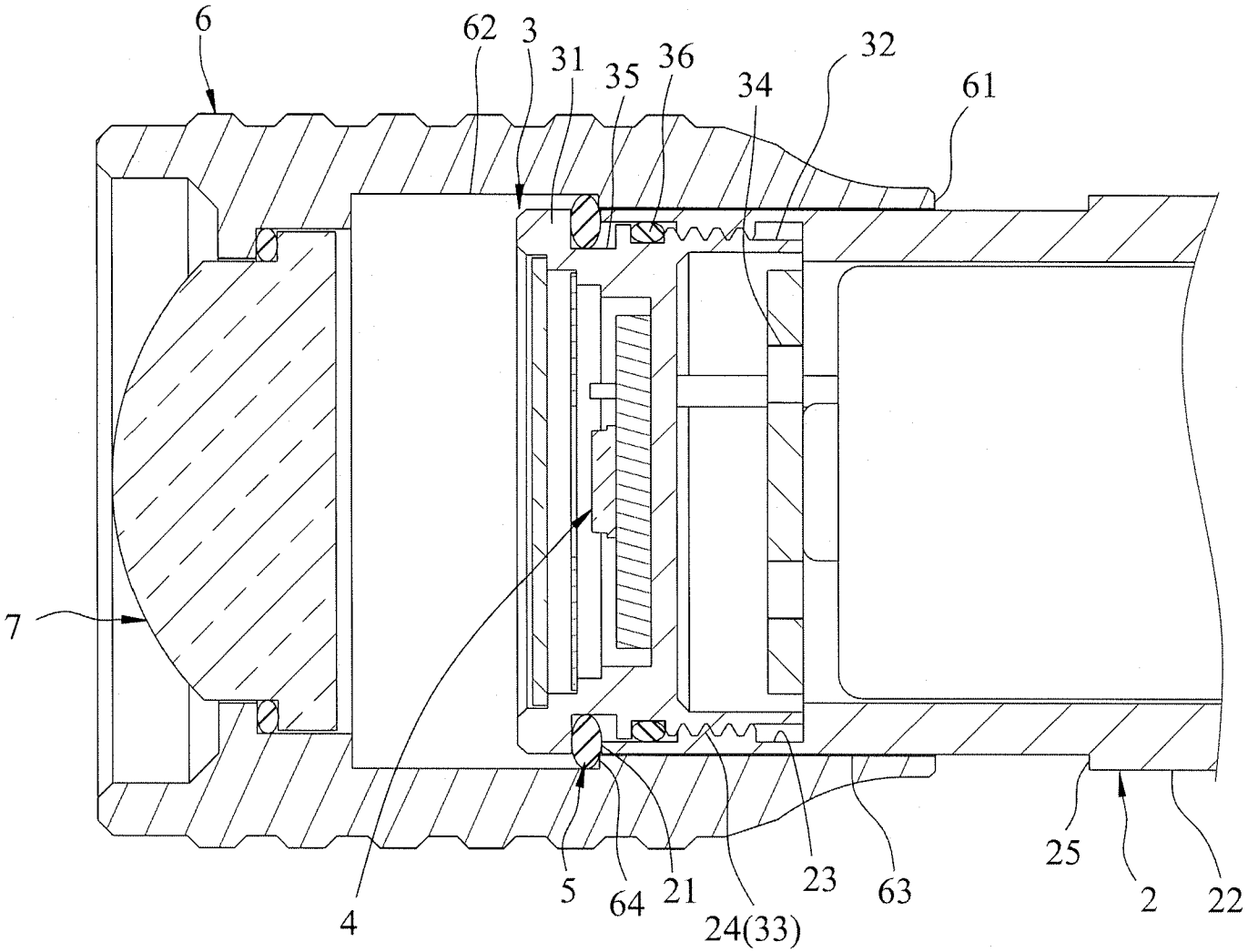
FIG. 6 is a fragmentary assembled sectional view of preferred embodiment, showing that the seat body is in the assembly position and the barrel adjustment and retaining assembly is in a lengthened state.

The seat body 3 has a protrusion 31 that is registered with the end surface 21 of the barrel body 2, an outer surrounding surface 32, and an external thread 33 that is formed on the outer surrounding surface 32 and that is configured to engage the internal thread 24 of the barrel body 2, such that the seat body 3 is movable relative to the barrel body 2 between a pre-assembly position (see FIG. 4) and an assembly position (see FIG. 5). The protrusion 31 of the seat body 3 is moved toward the end surface 21 of the barrel body 2 when the seat body 3 moves from the pre-assembly position to the assembly position. The seat body 3 further has a driving portion 34 that is adapted to be driven by a tool (not shown) extending into the barrel body 2 such that the seat body 3 is able to be moved from the pre-assembly position to the assembly position through operation of the tool. The seat body 3 is formed with an annular groove 35 that is adjacent to the protrusion 31 of the seat body 3 and that is formed in the outer surrounding surface 32 of the seat body 3. The seat body 3 further has a water-proof ring 36 disposed between the annular groove 35 and the external thread 33 and intimately contacting the inner surface 23 of the barrel body 2 so as to prevent water and moisture from moving into the barrel body 2.

The limiting component 5 is sleeved on the annular groove 35 of the seat body 3, and is disposed between the protrusion 31 of the seat body 3 and the end surface 21 of the barrel body 2 such that, when the seat body 3 is in the pre-assembly position, the limiting component 5 has a normal outer diameter (D1) (see FIG. 4), and when seat body 3 is in the assembly position, the limiting component 5 deforms to have an operating outer diameter (D2) (see FIG. 5) greater than the normal outer diameter (D1). That is to say, an outer diameter of the limiting component 5 is increased (from the normal outer diameter (D1) to the operating outer diameter (D2)) when the seat body 3 moves from the pre-assembly position to the assembly position. In this embodiment, the limiting component 5 is made of an elastic polymeric material. However, it should be noted that the limiting component 5 can also be made of an elastic polymeric material embedded with a reinforced fiber/a metal, or a spring plate. The shape and the material of the limiting component 5 disclosed herein should not be taken as a limitation of this invention and may vary depending on actual requirements.

The adjustment barrel 6 is sleeved slidably on the outer surface 22 of the barrel body 2, and has an end surface 61, a large diameter hole portion 62, a small diameter hole portion 63 and a shoulder surface 64. The end surface 61 is configured to abut against the shoulder surface portion 25 of the barrel body 2. The large diameter hole portion 62 is spaced apart from the end surface 61 of the adjustment barrel 6 and has a large diameter (D3) (see FIG. 3). The small diameter hole portion 63 is disposed between the large diameter hole portion 62 and the end surface 61 of the adjustment barrel 6 and has a small diameter (D4) (see FIG. 3) smaller than the large diameter (D3) of the large diameter hole portion 62. The shoulder surface 64 is formed between the large diameter hole portion 62 and the small diameter hole portion 63. When the seat body 3 is in the assembly position, the operating outer diameter (D2) of the limiting component 5 is greater than the small diameter (D4) of the small diameter hole portion 63 so that the shoulder surface 64 of the adjustment barrel 6 is movable to abut against the limiting component 5 to thereby limit the limiting component 5 to move in the large diameter hole portion 62 between a shortened state (see FIG. 5) and a lengthened state (see FIG. 6). In this preferred embodiment, the operating outer diameter (D2) of the limiting component 5 is equal to the large diameter (D3) of the large diameter hole portion 62. When the limiting component 5 is in the shortened state, the end surface 61 of the adjustment barrel 6 abuts against the shoulder surface portion 25 of the barrel body 2. When the limiting component 5 is in the lengthened state, the shoulder surface 64 of the adjustment barrel 6 abuts against the limiting component 5.

In this embodiment, the protrusion 3 has an outer diameter (D5) smaller than the small diameter (D4) of the small diameter hole portion 63.

The preferred embodiment of a barrel adjustment and retaining assembly further includes a light emitting element 4 that is disposed in the seat body 3 and an optical lens 7 that is disposed in the adjustment barrel 6 and that is aligned with the light emitting element 4 along an axial direction (I) of the barrel body 2.

When the seat body 3 is in the assembly position, the limiting component 5 can be moved between the shortened state and the lengthened state so as to adjust the relative position between the light emitting element 4 and the optical lens 7, thereby providing a variable-focus effect from a wide floodlight to a narrow beam.

The preferred embodiment of a method for assembling a barrel adjustment and retaining assembly according to the present invention includes the following steps of:

(a) preparing a barrel body 2, a seat body 3, a light emitting element 4 that is disposed in the seat body 3, a limiting component 5, an adjustment barrel 6 and an optical lens 7, the barrel body 2 having an end surface 21, an inner surface 23 and an internal thread 24 that is formed on the inner surface 23, the seat body 3 having a protrusion 31, an outer surrounding surface 32 and an external thread 33 that is formed on the outer surrounding surface 32, the limiting component 5 being deformable, the adjustment barrel 6 having an end surface 61, a large diameter hole portion 62 that is spaced apart from the end surface 61 of the adjustment barrel 6 and that has a large diameter (D3), a small diameter hole portion 63 that is disposed between the large diameter hole portion 62 and the end surface 61 of the adjustment barrel 6 and that has a small diameter (D4) smaller than the large diameter (D3) of the large diameter hole portion 62, and a shoulder surface 64 that is formed between the large diameter hole portion 62 and the small diameter hole portion 63.

(b) threading the internal thread 24 of the barrel body 2 on the external thread 33 of the seat body 3 to move the seat body 3 to a pre-assembly position such that the limiting component 5 is disposed between the protrusion 31 of the seat body 3 and the end surface 21 of the barrel body 2 and has a normal outer diameter (D1);

(c) placing the optical lens 7 in the adjustment barrel 6, followed by sleeving the adjustment barrel 6 on the seat body 3 and the barrel body 2 such that the limiting component 5 is disposed in the large diameter hole portion 62; and (d) threading the internal thread 24 of the barrel body 2 on the external thread 33 of the seat body 3 to move the seat body 3 to an assembly position, such that the limiting component 5 is clamped between the protrusion 31 of the seat body 3 and the end surface 21 of the barrel body 2 to deform to have an operating outer diameter (D2) greater than the normal outer diameter (D1) and greater than the small diameter (D4) of the small diameter hole portion 63, so that the shoulder surface 64 of the adjustment barrel 6 is movable to abut against the limiting component 5 to thereby limit the limiting component 5 to move in the large diameter hole portion 62.

Although the optical lens 7 is disposed in the adjustment barrel 6 in step (c) in this preferred embodiment, it should be noted that the optical lens 7 can also be disposed in the adjustment barrel 6 in step (a) or step (b) based on actual requirements. Moreover, in this preferred embodiment, in step (d), the internal thread 24 of the barrel body 2 is threaded on the external thread 33 of the seat body 3 in such a manner that a tool is extended into a driving portion 34 of the seat body 3 and is operated. In this embodiment, in step (d), the operating outer diameter (D2) of the limiting component 5 is equal to or smaller than the large diameter (D3) of the large diameter hole portion 62.

To conclude, the barrel adjustment and retaining assembly of this disclosure is advantageous for the following reasons:

(1) when the seat body 3 is in the assembly position, the limiting component 5 deforms to have the operating outer diameter (D2) so that the operating outer diameter (D2) of the limiting component 5 can be adjusted easily be larger than the small diameter (D4) and not larger than the large diameter (D3). Hence, high precision is not required for the limiting component 5. Moreover, a frictional force can be adjusted to a desired value by adjusting the relative position between the end surface 21 of the barrel body 2 and the protrusion 31 of the seat body 3 to meet the user's need. Furthermore, the limiting component 5 can also be used to prevent water and moisture from moving into the barrel body 2 when the limiting component 5 has the operating outer diameter (D2).

(2) since the limiting component 5 is made of an elastic polymeric material so that the adjustment barrel 6 is not likely to be damaged during relative movements between the limiting component 5 and the adjustment barrel 6, occurrence of vibration and collision therebetween can be avoided. Furthermore, since the limiting component 5 is a separate element that can be produced and replaced independently, the service life of the barrel adjustment and retaining assembly of this invention can be lengthened by simply replacing the limiting component 5.

(3) the assembling process can be performed by simply moving the seat body 3 to the pre-assembly position relative to the barrel body 2, followed by sleeving the adjustment barrel 6 along with the optical lens 7 on the seat body 3 and the barrel body 2, followed by moving the seat body 3 to the assembly position. Therefore, the assembling process is relatively simple and time saving. Moreover, since the optical lens 7 can be disposed in the adjustment barrel 6 before the adjustment barrel 6 is sleeved on the seat body 3 and the barrel body 2, the cover 16 of the conventional barrel adjustment and retaining assembly can be omitted, thereby reducing the volume, weight and the manufacturing cost of the barrel adjustment and retaining assembly.

While the present invention has been described in connection with what is considered the most practical and preferred embodiment, it is understood that this invention is not limited to the disclosed embodiments but is intended to cover various arrangements included within the spirit and scope of the broadest interpretation and equivalent arrangements.

What is claimed is:

1. A barrel adjustment and retaining assembly, comprising:

a barrel body having an end surface, an outer surface, an inner surface and an internal thread that is formed on said inner surface;

a seat body having a protrusion that is registered with said end surface of said barrel body, an outer surrounding surface and an external thread that is formed on said outer surrounding surface and that is configured to engage said internal thread of said barrel body such that said seat body is movable relative to said barrel body between a pre-assembly position and an assembly position, said protrusion of said seat body being moved toward said end surface of said barrel body when said seat body moves from said pre-assembly position to said assembly position;

a limiting component disposed between said protrusion of said seat body and said end surface of said barrel body such that when said seat body is in said pre-assembly position, said limiting component has a normal outer diameter, and when seat body is in said assembly position, said limiting component deforms to have an operating outer diameter greater than said normal outer diameter; and an adjustment barrel sleeved slidably on said outer surface of said barrel body, and having an end surface, a large diameter hole portion that is spaced apart from said end surface of said adjustment barrel and that has a large diameter, a small diameter hole portion that is disposed between said large diameter hole portion and said end surface of said adjustment barrel and that has a small diameter smaller than said large diameter, and a shoulder surface that is formed between said large diameter hole portion and said small diameter hole portion;

wherein when seat body is in said assembly position, said operating outer diameter of said limiting component is greater than said small diameter of said small diameter hole portion so that said shoulder surface of said adjustment barrel is movable to abut against said limiting component to thereby limit said limiting component to move in said large diameter hole portion.

2. The barrel adjustment and retaining assembly as in claim 1, wherein said protrusion has an outer diameter smaller than said small diameter of said small diameter hole portion.

3. The barrel adjustment and retaining assembly as in claim 2, wherein said seat body further has a driving portion that is adapted to be driven by a tool extending into said barrel body such that said seat body is able to be moved from said pre-assembly position to said assembly position.

4. The barrel adjustment and retaining assembly as claimed in claim 3, further comprising a light emitting element that is disposed in said seat body, and an optical lens that is disposed in said adjustment barrel and that is aligned with said light emitting element along an axial direction of said barrel body.

5. The barrel adjustment and retaining assembly as claimed in claim 4, wherein said seat body is formed with an annular groove that is adjacent to said protrusion of said seat body and that is formed in said outer surrounding surface of said seat body, said limiting component being sleeved on said annular groove.

6. The barrel adjustment and retaining assembly as claimed in claim 5, wherein said limiting component is made of an elastic polymeric material.

7. The barrel adjustment and retaining assembly as claimed in claim 5, wherein said seat body further has a water-proof ring disposed between said annular groove and said external thread and intimately contacting said inner surface of said barrel body.

8. The barrel adjustment and retaining assembly as claimed in claim 1, wherein said outer surface of said barrel body has a shoulder surface portion, said end surface of said adjustment barrel being configured to abut against said shoulder surface portion.

9. A method for assembling a barrel adjustment and retaining assembly, comprising the steps of:

(a) preparing a barrel body, a seat body, a limiting component and an adjustment barrel, the barrel body having an end surface, an inner surface and an internal thread that is formed on the inner surface, the seat body having a protrusion, an outer surrounding surface and an external thread that is formed on the outer surrounding surface, the limiting component being deformable, the adjustment barrel having an end surface, a large diameter hole portion that is spaced apart from the end surface of the adjustment barrel and that has a large diameter, a small diameter hole portion that is disposed between the large diameter hole portion and the end surface of the adjustment barrel and that has a small diameter smaller than the large diameter of the large diameter hole portion, and a shoulder surface that is formed between the large diameter hole portion and the small diameter hole portion.

(b) threading the internal thread of the barrel body on the external thread of the seat body to move the seat body to a pre-assembly position such that the limiting component is disposed between the protrusion 31 of the seat body 3 and the end surface 21 of the barrel body 2 and has a normal outer diameter;

(c) sleeving the adjustment barrel on the seat body and the barrel body such that the limiting component is disposed in the large diameter hole portion; and (d) threading the internal thread of the barrel body on the external thread of the seat body to move the seat body to an assembly position such that the limiting component is clamped between the protrusion of the seat body and the end surface of the barrel body to deform to have an operating outer diameter greater than the normal outer diameter and greater than the small diameter of the small diameter hole portion so that the shoulder surface of the adjustment barrel is movable to abut against the limiting component to thereby limit the limiting component to move in the large diameter hole portion.

10. The method as claimed as claim 9, wherein, in step (d) the internal thread of the barrel body is threaded on the external thread of the seat body in such a manner that a tool is extended into a driving portion of the seat body and is operated.

* * * * *